US005266099A

United States Patent [19]

Kelley

[11] Patent Number: 5,266,099

[45] Date of Patent: Nov. 30, 1993

[54] METHOD FOR PRODUCING CLOSED CELL SPHERICAL POROSITY IN SPRAY FORMED METALS

[75] Inventor: Paul Kelley, Pasadena, Md.

[73] Assignee: The United States of America as represented by the Secretary of the Navy, Washington, D.C.

[21] Appl. No.: 927,991

[22] Filed: Aug. 11, 1992

[51] Int. Cl.[5] ..... B22F 7/04

[52] U.S. Cl. ..... 75/337; 75/338; 264/11

[58] Field of Search ..... 75/337, 338, 339; 264/11, 12

[56] References Cited

U.S. PATENT DOCUMENTS

| | | | |
|---|---|---|---|
| 2,434,775 | 1/1948 | Sosnick | 75/415 |
| 2,751,289 | 6/1956 | Elliot | 75/415 |
| 3,671,221 | 4/1972 | Berry | 75/415 |
| 3,743,353 | 0/1976 | Lupinsky | 297/445 |
| 3,940,262 | 0/1976 | Niebylski et al. | 75/415 |
| 4,460,529 | 7/1984 | Schultze | 354/414 |
| 4,569,821 | 2/1986 | Duperray | 419/2 |
| 4,735,862 | 4/1988 | Heinzl | 428/550 |
| 4,877,705 | 10/1989 | Polidor | 222/591 |
| 4,917,852 | 4/1990 | Poole | 264/500 |
| 4,920,084 | 4/1990 | Robyn | 501/94 |
| 4,999,182 | 3/1991 | Baumard | 501/103 |
| 5,004,710 | 4/1991 | Anderson | 501/103 |
| 5,080,672 | 1/1992 | Bellis | 419/8 |
| 5,110,631 | 5/1992 | Leatham | 427/422 |
| 5,120,567 | 6/1992 | Frind | 427/422 |

FOREIGN PATENT DOCUMENTS

| | | | |
|---|---|---|---|
| 1073002 | 2/1984 | U.S.S.R. | 75/338 |

OTHER PUBLICATIONS

Michael W. Kearns et al "Manufacture of a Novel Porous Metal" The International Journal of Powder Metallurgy vol. 24 No. 1 pp. 59–64.

R. L. Martin "Porous Core/BE Ti-6-4 Development for Aerospace Structures" APMI Conf. 1990.

Paul Kelley et al "Increased Porosity in Spray Formed Phosphor Bronze" International Journal of Powder Metallurgy Dec. 1991.

*Primary Examiner*—George Wyszomierski

*Attorney, Agent, or Firm*—Charles D. Miller

[57] ABSTRACT

Metal and metal alloy preforms having closed cell, spherical porosity are spray formed at high deposition rates by introducing blowing agents into the thixotropic semisolid deposition layer, within which gas formed in thermal decomposition reactions are trapped. Density reductions of nearly 30% were generated in a phosphor bronze matrix, using barium carbonate as the blowing agent. Hollow glass particles were produced in the same matrix alloy by injection of microsphere precursor frit containing sulfur. A simple Newtonian heat transfer model of agent heating in the spray predicts agent/matrix compatibility. Along with modest improvements in damping capacity, tensile and compressive properties were found to be equal or superior to powder metallurgy product at the same porosity levels.

18 Claims, 4 Drawing Sheets

METHOD FOR PRODUCING CLOSED CELL SPHERICAL POROSITY IN SPRAY FORMED METALS

BACKGROUND OF THE INVENTION 1. Field of the Invention

This invention relates to spray forming of porous metals at high deposition rates and particularly relates to porous metals having spherical pores. 2. Review of the Prior Art In high deposition rate spray forming, a stream of molten metal is typically atomized by an inert gas, producing a spray of droplets that are accelerated towards the substrate. The spray impacts the substrate and consolidates upon it to form a nearly fully dense deposit, termed a preform. The metal flow rate, superheat, flight distance, and atomization gas pressure are controlled so that the correct ratio of liquid to solid material is delivered to the preform surface. Liquid permits incoming droplets to be fully incorporated into the preform without boundaries between successive splats. Fracture during impaction breaks up the dendritic structure of incoming particles, and coarsening during cooling generates an equiaxed structure with the scale of segregation limited to tens of microns.

Spray forming offers considerable microstructural refinement, as does conventional powder metallurgy (P/M) processing, and additionally eliminates many of P/M's powder handling and compaction stages such as sieving, storage, cold pressing, and sintering. It has been successfully applied to a wide range of alloys and metal matrix composites. Spray forming can also produce fully dense preforms that can be roll extruded into IN625 piping with mechanical properties equivalent to conventionally processed material at cost savings as high as 30–50% compared to conventional ingot metallurgy.

Currently there are a number of spray forming pilot plants producing rolls, thin strip, and extrusion billets in copper, aluminum, and steel alloys. U. S. Pat. No. 5,110,631, for example, teaches the production of metal or metal alloy spray deposits using an oscillating spray for continuous length or for producing tubular, roll, ring, cone, or other axi-symmetric shaped deposits of discrete length, a controlled amount of heat being extracted from the molten metal or metal alloy in flight and/or on deposition and base porosity being considerably reduced with continuous production techniques involving a single pass.

In spray forming of conventional engineering materials, considerable effort has been directed at elimination of porosity in the preform. Such porosity can be generated by a number of different mechanisms. One of the most prevalent is porosity caused by lack of sufficient liquid in the spray to fill interstices and completely weld solid particles delivered to the preform surface. 'Cold' porosity can also be caused by excess heat removal from the preform, thereby creating a solidified surface. Often these conditions are present at the edge of the spray and in the first few millimeters deposited on an unheated substrate. When depositing material in multiple passes, a banded structure of dense material layered with porosity can be formed. Other types of porosity are associated with particulate injection, rejection of dissolved gas during solidification, or excessive splashing/turbulence on the preform surface. In many cases, these problems are eliminated or minimized through proper spray conditions and substrate selection. Post processing such as hot rolling, extrusion, and hot isostatic pressing (HIPping) has been effectively used to achieve full density and mechanical properties superior to wrought ingot metallurgy product.

In many materials, a limited amount of porosity is accepted, and its effect on mechanical properties is allowed for in the design process. In P/M materials, porosity is an artifact of the consolidation process and is frequently accepted in a trade-off for increased control of distortion and reduction of sintering time or temperature. An open cell pore geometry can be produced by incomplete sintering and is utilized to contain oils in self-lubricating bearings, as flame arresting inserts, as metallic filters, and in a variety of other applications.

Fewer applications have been found that take advantage of the better mechanical properties of closed cell metallic materials. One of the reasons for these better properties is that angular, interconnected pores are stress concentrators and provide a pathway for crack growth, whereas spherical cells can act to blunt the crack tip.

In "Manufacture of a Novel Porous Metal", *Int. J. Powder Metall.*, 1988, vol. 24, no. 1, p. 59, M. W. Kearns et al disclosed that closed cell porosity can be generated in a HIPped P/M material by backfilling a controlled amount of argon, as a pressure-developing medium which exhibits limited solubility in the matrix material, into Ti-6Al-4V powders after canning, with pore formation and growth kinetically controlled in a post-HIP heat treatment for powder consolidation which allows the pressure developing medium to be contained within numerous discrete pores in the matrix material.

In the development of a porous-core, sandwich panel-type structure using Ti-6wt%Al-4wt%V (Ti-6-4) blended elemental (BE) powder, R. L. Martin et al found that introduction of inert gas to metal powder prior to consolidation allows formation of controlled porosity during subsequent heat treatment, causing sufficient diffusion to produce a fully homogenized matrix. Surface densification processing creates an in-situ sandwich structure having a fully dense shell with a porous, low-density core, the gas porosity formed in the metallic matrix being uniform and rounded and therefore behaving innocuously, to produce substantial increases in specific flexural stiffness. *Porous Core/BE Ti-6-4 Development for Aerospace Structures,* 1991 Powder Metallurgy Conference & Exhibition, Chicago, 1991.

As noted by H. E. Boyer, "Secondary Operations Performed on P/M Parts and Products", "Metals Handbook", Vol. 7, 1984, American Society for Metals, Metals Park, OH, p. 461, porosity also renders some alloys free-machining, so that they require less cutting fluids than their wrought counterparts.

Such results show the potential for reduced density materials in structural applications where weight savings are critical, such as machinery enclosures for acoustic signature reduction, high temperature damping coatings, and energy absorbing barriers.

Porous metallic materials as a group have many unusual properties such as improved acoustic damping properties, improved impact energy absorption, low thermal conductivity, and stability at high temperatures.

Spray deposition offers unique opportunities for the production of composite materials by permitting introduction of phases which would normally be rejected by the melt during ingot metallurgy due to density differences or surface tension effects. During deposition a thick surface layer of the preform is in a semisolid state with equiaxed grains on the order of 50 microns in diameter, as reported by P. Mathur et al, "Process Control, Modeling and Applications of Spray Casting", *J. Met.*, 1989, Vol. 41, no. 10, p. 23.

This type of structure is very similar to that formed during rheocasting and is thixotropic, with apparent viscosity rising sharply with increasing fraction of solid and decreasing shear rate, according to M. C. Flemings, "Behavior of Metal Alloys in the Semisolid State", *Metall. Trans. A*, 1991, vol. 22, p. 957 and A. R. E. Singe, "A Future for Spray Forming", 1st International Conference on Spray Forming, Swansea, 1990. However, attempts to increase porosity in spray formed materials by deposition under cold conditions result in poor mechanical properties which can be attributed to the highly angular, interconnected porosity that is formed.

There is consequently a need for a method for spray forming a porous metal having closed cell spherical porosity that will impart increased strength to the metal.

SUMMARY OF THE INVENTION

It is accordingly an object of this invention to provide a method for spray forming a porous metal deposit or preform having closed cell spherical porosity.

It is also an object to be able to use this spray forming method at a high deposition rate.

It is further an object to obtain tensile and compressive properties in the porous metal preform that are at least equal to powder metallurgy products at the same porosity levels.

It has surprisingly been discovered that the pore generation mechanism can be changed to produce closed cell spherical porosity in a spray formed preform having increased strength by introducing a blowing agent into the preform that reacts at high temperatures and produces gas within the thixotropic surface layer while the preform is solidifying.

It was particularly discovered that the viscosity of the thixotropic semisolid deposition layer, along with the rapidly advancing deposition and solidification fronts, can be used to reduce or eliminate rise velocity (and coalescence) of gas pores formed by the small amount of blowing agent accompanying the sprayed metallic materials, thereby entrapping the gas pores in the preform. The particles of blowing agent are injected at room temperature into the point of atomization and are accelerated towards the preform by a carrier gas.

During flight, a large fraction of the particles collide with metal droplets and are heated by conduction, while those that do not collide are heated at much slower rates by convection and radiation. After impaction with the preform, the particles are quickly incorporated below the advancing deposition surface. It is important that the gas generating reaction not take place until after such incorporation.

This delay in gas generation can be obtained in several different ways. Because the gas generation reaction is thermally driven, the delay can be adjusted by changing the thermal mass of the blowing agent (droplet or particle diameter) or by changing matrix alloys to get different melting temperatures at which the gas is generated. In general, the gas generating reaction should occur at temperatures near the solidus of the matrix material.

The spray formed porous metal or metal alloy preform of this invention contains closed cell, spherical pores formed by a blowing agent. The majority of the pores have diameters in the range of 100 to 250 microns. The preferred metal alloy is phosphor bronze, and the preferred blowing agent is barium carbonate having a size of −270 mesh or borosilicate glass precursor frit having a nominal 0.05% sulfur content and having a size of −170/+270 mesh.

Injection of the blowing agent may be accomplished in a number of different ways. One way is to blend the powdered or liquid blowing agent into the atomization gas at a controlled rate. In this manner, the agent is directly mixed with the molten metal droplets and quickly accelerated toward the substrate. Another way is to inject the blowing agent into the recirculating gas in a multistage gas atomizer. It is also possible to inject the blowing agent directly at the preform along a path that will not cause it to contact the molten droplets in flight, so that the agent will remain at relatively low temperatures until impaction with the preform surface.

An endothermic gas generating reaction can alternatively be selected in order t rapidly solidify the material surrounding the pores and entrap the gas more quickly. If the gas generation time is comparable to the time between splats, the size of a single pore will be limited to the diameter covered by a single splat—about 150 microns. If gas generation requires more time, larger pores can be formed under the thicker liquid/solid layer that is rapidly deposited on the preform.

The method of this invention for spray forming a preform, containing closed cell spherical porosity for increased strength, onto a substrate, comprises:

A. heating a selected metallic material to obtain a melted metallic material having a selected superheat;
B. passing the melted metallic material through a nozzle to form a melt stream;
C. accelerating the melt stream toward the substrate with a stream of an inert gas to form an atomized melt stream at a point of atomization;
D. injecting particles of a blowing agent into the point of atomization; and
E. selectively receiving the atomized melt stream mixed with the blowing agent particles on the substrate to form the preform.

The process of this invention is designed to produce porous metallic materials with a highly uniform distribution of pore sizes. It can produce these materials from any pure metal or metal alloy that can be melted in bulk quantities and poured through a refractory nozzle. Only the refractory metals such as tungsten have to be melted and dispensed in a technique that does not involve a ceramic nozzle, but the actual porous material-producing step is the same. These metallic materials are accordingly selected from a wide range of alloys and especially from the group consisting of copper based, nickel based, iron based, and aluminum based alloys.

The blowing agents employed in the practice of this invention may be classified as acting by: (a) decomposition or volatilization to produce a gas such as $CO_2$, $Br_2$, $O_2$, and the like from an inorganic compound, such as $BaCO_3$, $FeCO_3$, $NiCO_3$, $CdBr_2$, $CeO_2Co_3$, $Cs_2O_2$, $GaCl_2$, $PbBr_2$, $Li_2SO_4$, $MnSO_4$, $K_2Cr_2O7$, KCNS. $RbBF_4$, $Rb_2CO_3$, $AgNO_3$, $NaClO_4.H_2O$, TlBr, TlCl, TlF, TlI, $ThI_4$, $SnBr_2$, $SnI_2$, $Y_2(SO_4)_3.H_2O$, $ZnBr_2$, and $ZnI_4$, (b) decomposition or vaporization to produce a gas from an organic compound or metal organic compound, such as metal carbonyls, metal hydrides, certain azides, and poly(alkylene carbonates), or (c) vaporization to produce a vapor from an element, such as arsenic, cadmium, cesium, potassium, rubidium, selenium, sodium, sulfur, and zinc. In general, the blowing agents may be any material which decomposes or volatilizes between about 425° C. and about 1360° C. The blowing agents are selectively injected into the point of atomization as a particulate material of a selected size range or as a sodium borosilicate glass precursor frit into which they have been incorporated.

Many different polymers that burn and generate $CO_2$ are useful as blowing agents. Some, such as poly(alkylene carbonates), are suitable blowing agents for lower melting point metals because they are designed to decompose cleanly at high temperatures into $H_2O$ and $CO_2$ and are currently used as fugitive mold patterns in the casting of metal parts.

Certain metal azides decompose and generate $N_2$ in a non-explosive reaction. They can be used as blowing agents in materials that are susceptible to embrittlement from other blowing agents. Low boiling point compounds and gels that contain water of hydration can also be useful blowing agents.

Alkaline earth and alkali metal carbonates having a range of equilibrium decomposition temperatures from 540° C. to 1360° C. are suitable, and metal carbonates such as $FeCO_3$ and $NiCO_3$, which decompose into the metal oxide and $CO_2$, are especially interesting blowing agents because oxides can be used to disperse and strengthen many alloy systems. Thus the blowing agent can not only generate the gas for the pores, but also can strengthen the matrix material. $CeO_2CO_3$ is another metal carbonate blowing agent that can be used to generate a very stable oxide, $CeO_2$, in the matrix material.

Metal carbonyls such as $Cr(CrO)_6$ and $Fe(CO)_6$ decompose into the elemental metal and large volumes of $CO_2$ and are accordingly useful as blowing agents to generate large pores in lower melting point alloys.

Carbon can be injected as a blowing agent in some metals that contain oxygen. Copper based alloys are suitable because of the eutectic between copper and copper oxide. Carbon has a greater affinity for oxygen at higher temperatures and will reduce the oxide and accordingly form $CO_2$ with the preform. Similarly, compound particles composed of an oxide and carbon which are mechanically bonded together can be used as a blowing agent. At higher temperatures, the carbon will reduce the oxide and form $CO_2$.

Metal hydrides such as $TiH_2$, $Zr_2$, and $HfH_2$ are also good candidates for blowing agents in this process. The metal hydrides decompose at elevated temperatures into hydrogen gas and the elemental metal.

Because it is also possible to spray deposit glasses and ceramic materials, the same process can be applied to the production of porous glasses and ceramics, and many of the same blowing agents and concepts can be applied to these materials.

A computer model was developed to predict the combination of blowing agent, blowing agent diameter, matrix material, and process parameters that allows incorporation of the agent in the preform before gas generation occurs. Moreover, the blowing agent is selected to have an appropriate size and type for the metallic material so that the agent's thermal mass is large enough and the agent's decomposition temperature is high enough to prevent excessive gas generation in flight. The choice of blowing agent is also influenced by the specific heat and heat transfer characteristics of the particles during the 10-millisecond flight from the point of atomization to the deposition surface.

The superheat in the metallic material is sufficient to produce a thixotropic semisolid deposition layer on the preform. The particles are quickly incorporated within this layer, below the advancing deposition surface thereof, and then decompose, as indicated schematically in FIG. 1 the viscosity of the layer is sufficient to entrap gas pores formed by decomposition of the blowing agent particles. The barium carbonate particles reach thermal equilibrium with the phosphor bronze droplets at about 750° C.

The barium carbonate is alternatively mixed with phosphor bronze powders, functioning as a carrier of the barium carbonate, to form a mixture which is injected into the point of atomization. The droplets have a velocity of about 60 meters per second during flight toward the substrate. Velocity predictions for the nitrogen gas and an 80-micron CA524 phosphor bronze droplet containing the barium carbonate particle are shown in FIG. 2. The droplet is accelerated towards the preform and reaches a velocity of about 60 m/s, total flight time being less than 10 ms. Atomization gas velocity is quickly reduced as momentum is transferred to the droplet.

Temperature changes are plotted in FIG. 3 during this flight, as the same metal droplet is first rapidly cooled to its liquidus temperature (1000° C.) and then more slowly as the latent heat of fusion is released until the solidus temperature (880° C.) is reached after 250 mm of flight. Nitrogen atomization gas reaches nearly 400° C. by the time it gets to the preform surface (typically a distance of 350 mm). The upper bound heating rate for the 50-micron barium carbonate particle shows that it just reaches thermal equilibrium with the bronze droplet at 750° C.

The barium carbonate is 0.44 to 8.8 weight percent of the mixture, an amount sufficient to generate a large volume of $CO_2$. The feed rate of the mixture is within the range of 0.5 and 1.5 kg/minute.

Hollow glass microspheres are another preferred type of blowing agent. These microspheres are made by first preparing glass precursor frit containing a small concentration of sulfur. When rapidly heated, the sulfur reboils and generates $SO_3$ or $SO_2$ gas. In order for the sulfur to boil, however, it is important that the precursor powder is heated to a temperature above the softening point of the glass (750° C.) in less than about 10 milliseconds. In commercial production of glass microspheres, precursor powders are passed through a flame where the glass softens and gas is generated, some of which is trapped in the glass spheres after cooling.

In this invention in which precursor powders are injected as a blowing agent, hollow glass microspheres are formed to produce syntactic porous materials having improved damping properties because of the large number of interfaces between materials with different acoustic impedances.

Prior to injection, the glass precursor frit is quite angular in shape with no visible internal pores. After incorporation into the phosphor bronze preform, the glass softens and forms a smooth interface with the matrix. Rounded pores could be seen in the majority of the glass particles.

Although the level of sulfur in the glass was designed to generate pores of at least 200 microns in diameter, the pore diameters in the spray formed preform were typically 150 microns. This reduction may have been caused by the lower temperatures reached after impact (960° C. preform temperature as measured with a two-color pyrometer), compared to 1200° C. typically obtained in conventional microsphere processing.

Density reductions of up to 14.6% were obtained by using glass precursor frit. Average grain size was reduced to about 40 microns.

Injection of a sulfur-doped borosilicate glass into the spray resulted in a syntactic porous microstructure. Injection of $BaCO_3$ generated nearly 30% porosity in a phosphor bronze matrix. Area median pore diameter was 8 microns for the monolithic spray formed material and 180 microns for pores generated by thermal decomposition of $BaCO_3$.

Tensile and compressive mechanical properties equal or superior to those of conventional powder metallurgy (P/M) products at the same porosity level were obtained. Damping capacity of the material with $BaCO_3$ injection at 22% porosity was twice that of the spray formed material with 3% porosity. Improvements in damping capacity were also obtained in the porous material made with hollow glass particles.

Among many potential uses for the porous metallic materials of this invention are acoustic signature reduction on shipboard systems (especially those applications requiring higher temperature stability than is possible in polymeric viscoelastic materials), acoustic signature reduction of propulsor blades, and reduction of airborne noise on surface ships by use in equipment housings and panels, high temperature seals, and shock and impact energy absorbers.

Other applications include lightweight structures for aerospace vehicles, strain matching layers between materials with different coefficients of thermal expansion, heat exchangers, substrates for solid state catalysts, stiffening panels, baffles, military arming delay switches, and cryogenic tanks.

The process of this invention is not limited to producing one shape of porous material. By spraying onto a rotating mandrel and concurrently injecting blowing agents, a porous metal tubular preform can be produced. Similarly, a round billet of porous material can be formed by concurrently injecting blowing agents during spray deposition onto a rotating flat disk. Any shape that can be spray formed (plate, sheet, tubular, billet, simple non-axisymmetric parts, etc.) can also be formed out of a porous metallic material by use of this process.

Using the method of this invention, it is also possible to control directly the size, percent, and distribution of pores within the metallic material by varying the size and flow rate of the blowing agent. Additionally, by controlling the time during which the agent is injected during spray deposition, i.e., by injecting the blowing agent into the preform surface only during passes that form the center of the piece, a dense skin on both sides of the piece can be maintained. Thus a sandwich structure of strong, dense skin on a lightweight center can be formed in a plate, and pipes can be formed with a dense internal diameter and a porous outer diameter.

DESCRIPTION OF THE PREFERRED EMBODIMENTS

The experimental procedure that was used in all of the following examples began with induction melting approximately 15 kg of phosphor bronze (CA52400) under nitrogen gas cover in an alumina crucible. Phosphor bronze (Cu-10Sn-0.3P) was chosen as the matrix material because it is essentially a simple binary alloy with elements that will not react with the selected blowing agents. It has a wide melting range which was expected to increase preform solidification time and allow for pore generation. Mechanical property data are also available for this alloy as a function of porosity.

Figure 1:
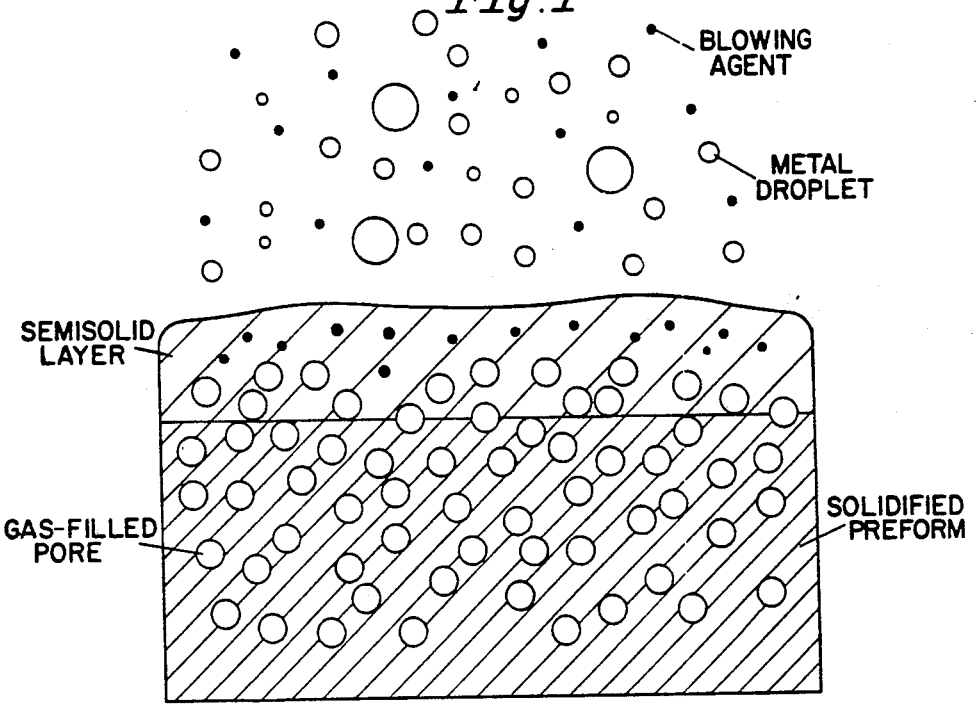
FIG. 1 is a schematic showing the deposition process for producing spray formed materials having increased porosity.
Figure 2:
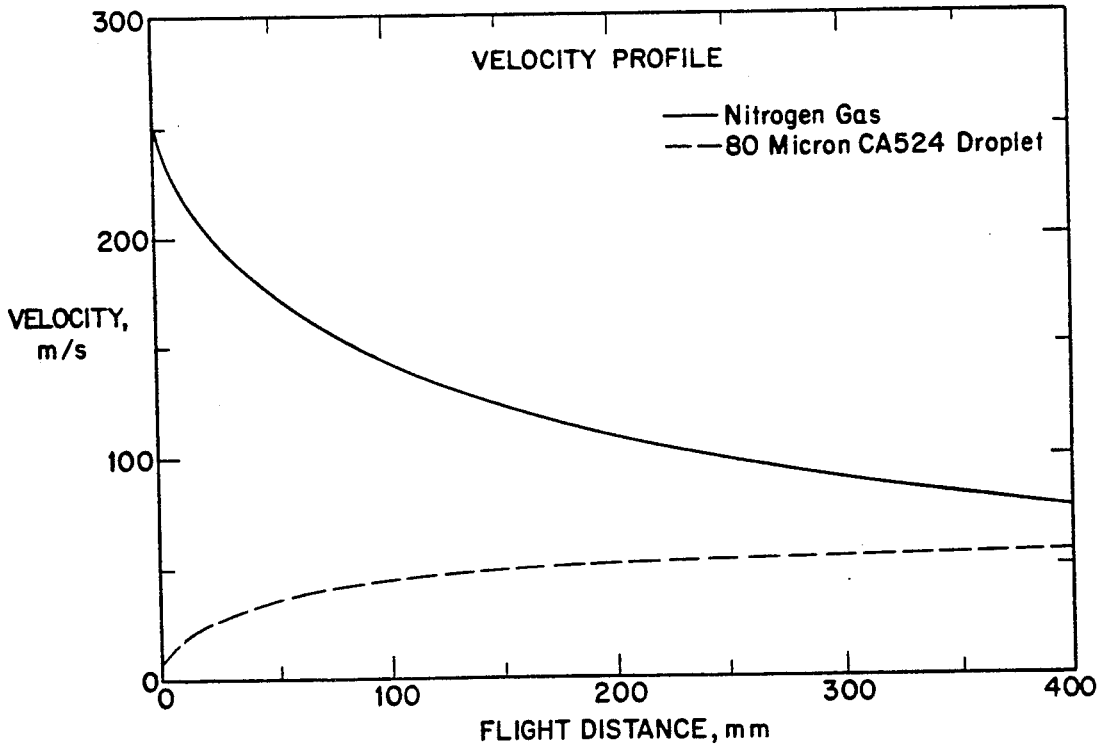
FIG. 2 is a graph of the predicted velocity profile of nitrogen gas and bronze droplets in flight, atomization occurring at 0 mm flight distance, impact with preform occurring at 350 mm.
Figure 3:
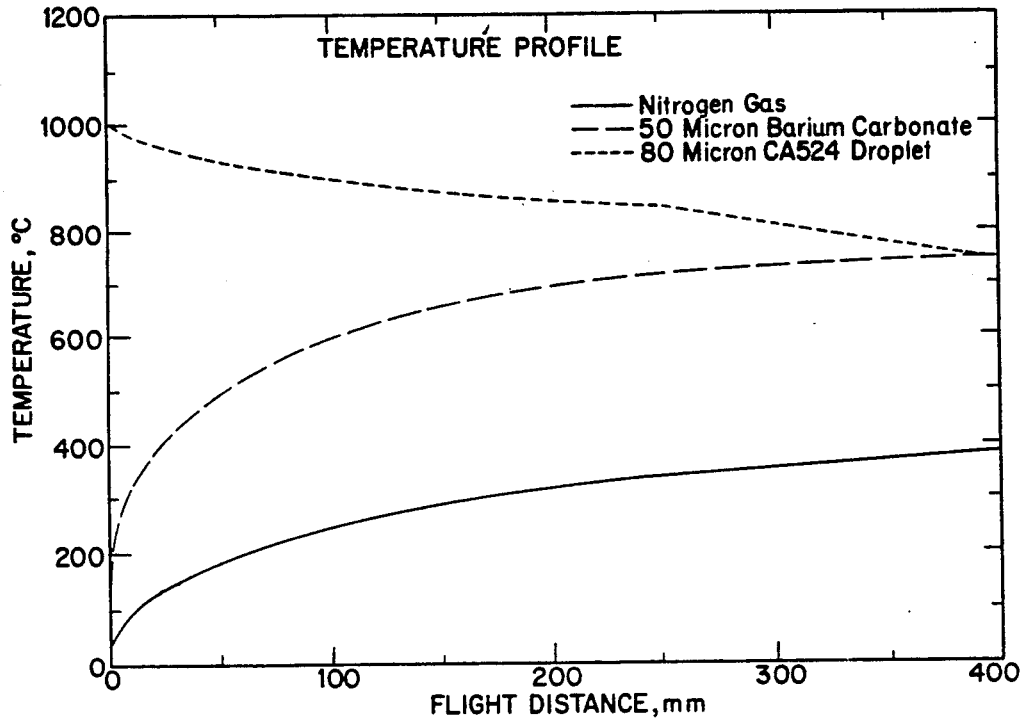
FIG. 3 is a graph of the predicted temperature profile of nitrogen gas, bronze droplets, and $BaCO_3$ particles in flight.

A graphite stopper rod with integral K-type thermocouple was used to initiate pour at the desired superheat (typically 80° C.). During pour, the cover gas pressure was increased at a rate of 3.1 bar/s to compensate for the fall in liquid metal head. After passing through a zircon nozzle with 5.5 mm inner diameter, the melt stream was atomized with nitrogen at pressures of 7 to 8 bar. The atomizer was scanned at 16 Hz across a cordierite disk substrate at a flight distance of 350 mm while the disk was rotating at 210 rpm in a plane 35° from normal to the spray direction. Melt flow rates were about 23kg/min. As schematically shown in FIG. 1, resultant preforms were 150 mm in diameter and about 100 mm in height and weighed about 11 kg.

Preform density was determined by Archimedes method and corroborated using quantitative metallography on a Leco 2001 TM analyzer. All mechanical testing was performed on specimens machined from preforms in the as-sprayed condition. Tensile specimens were subsize rounds, 6.35 mm in diameter with 38.1 mm gage length and tested as per ASTM Standard E-8. Compressive yield was determined from 12.7 mm diameter cylinders 25.4 mm in length. Density of each mechanical test specimen was determined from specimen weight divided by calculated volume.

Damping capacity was measured with a Polymer Laboratories Dynamic Mechanical Thermal Analyzer (DMTA), using a fixed-guided cantilevered test configuration. One end of the specimen was held stationary with the other attached to a controlled drive shaft. A small semisolid time-varying mechanical force was applied to the drive shaft, and the displacement of the sample was measured. The phase angle, delta, of the lag between applied load and measured displacement was calculated. The tangent of delta is a measure of damping capacity and is commonly called the loss factor. All samples were tested at 1 Hz while ramping the temperature 1° C. per minute from −20° to 250° C. and inducing a maximum of 100 microstrain.

Cast feedstock microstructure contains large alpha dendrites with significant coring, along with interdendritic alpha/delta eutectoid regions. Segregation and retention of high temperature phases such as delta occur readily in cast copper-tin alloys. Density and chemical content information are given in Tables 1 and 2 for cast phosphor bronze.

The invention may be more clearly understood by considering the following spray forming examples.

EXAMPLE 1

Preform A

A control preform was spray formed from 15 kg of melted phosphor bronze. Density information is given in Table 1, and chemical content of the preform is furnished in Table 2 for Preform A. Such conventional spray forming without injection of blowing agents significantly homogenizes the microstructure of a cast feedstock into single phase alpha with no observable coring under optical examination. Grain size is approximately 80 microns. However, spray forming does introduce porosity that is largely confined to grain boundaries and triple points.

TABLE 1

Comparison of Densities of Feedstock and Spray Formed Phosphor Bronze Billets

| | Blowing Agent | Weight % Agent | Density (g/cc) | % Dense | % Porosity |
|---|---|---|---|---|---|
| Cast Feedstock | — | — | 8.74 | 100.0 | 0.0 |
| Perform A | — | — | 8.49 | 97.1 | 2.9 |
| Perform B | glass - .05% S | 5.71 | 7.48 | 85.6 | 14.4 |
| Perform C | $BaCO_3$ | 0.03 | 8.03 | 91.9 | 8.1 |
| Perform D | $BaCO_3$ | 0.06 | 7.96 | 91.1 | 8.9 |
| Perform E | $BaCO_3$ | 0.05 | 6.98 | 79.9 | 20.1 |
| Perform F | $BaCO_3$ | 0.12 | 6.78 | 77.6 | 22.4 |
| Perform G | $BaCO_3$ | 0.18 | 6.19 | 70.8 | 29.2 |

TABLE 2

Chemical Composition (wt. %) of Starting Feedstock and Spray Formed Billets. Ballance is Copper.

| | Sn | P | Si | Ba | O | N | S |
|---|---|---|---|---|---|---|---|
| Feedstock (CA52400) | 10.5 | .30 | .006 | .001 | .030 | .0009 | .007 |
| Spray Formed Matrix (A) | 9.95 | .30 | .004 | <.001 | .004 | .0010 | .004 |
| Spray Formed w/Glass Frit (B) | 9.94 | .30 | .41 | .005 | .66 | .0023 | .009 |
| Spray Formed w/$BaCO_3$ (C) | 9.88 | .25 | .004 | .015 | .005 | .0007 | .004 |
| Spray Formed w/$BaCO_3$ (E) | 9.43 | .27 | .002 | .064 | .005 | .0009 | .007 |
| Spray Formed w/$BaCO_3$ (G) | 9.77 | .24 | .004 | .28 | .007 | .0019 | .007 |

Figure 4:
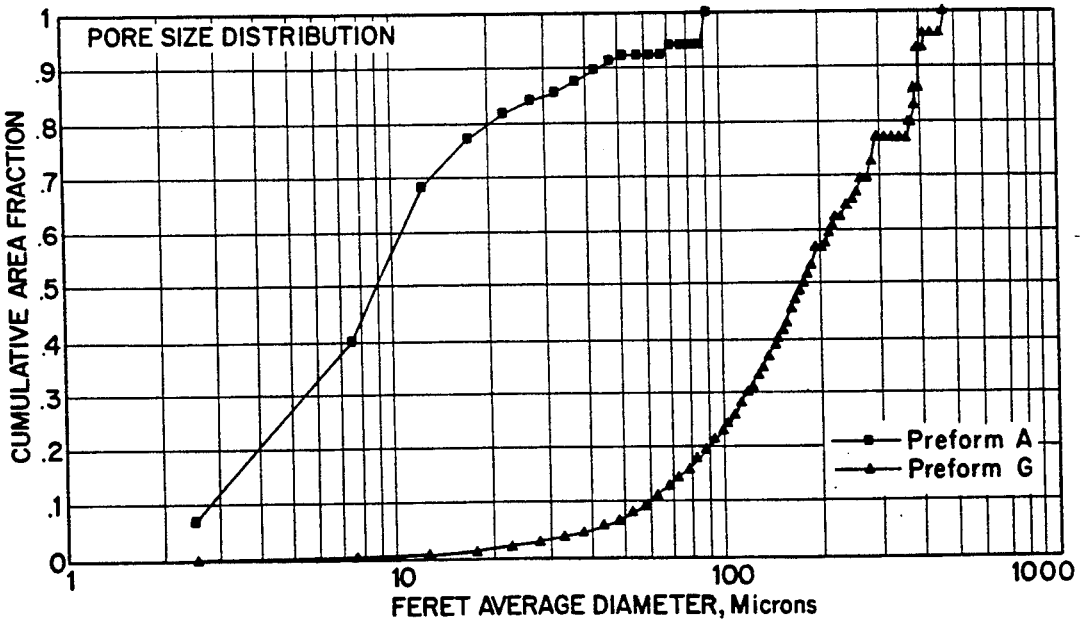
FIG. 4 is a graph showing the pore size distribution of two preforms, as cumulative pore area fraction measured by quantitative metallography.

This fine porosity is largely confined to grain boundaries and triple points and may be generated during deposition by mechanical entrapment of nitrogen and/or by rejection of dissolved gases during solidification; it is accordingly called "nitrogen" porosity. The pore size distribution is fairly narrow with an area median pore diameter of 8 microns, as shown in FIG. 4. Using quantitative metallography, fine nitrogen porosity was determined to be nearly 3 volume percent.

EXAMPLE 2

Preform B

Another 15 kg of melted phosphor bronze was fed through a nozzle while 5.71 wgt. % of 9lass precursor frit containing 0.05%S was injected into the point of atomization. As shown in Table 1, a density reduction of 14.4% was obtained, compared to the cast phosphor bronze. As would be expected, an increased amount of silicon was found upon chemical analysis, as shown in Table 2. Microscopic inspection showed that the glass had softened and formed rounded pores and a smooth interface with the matrix, although nitrogen porosity was also present. The level of sulfur in the glass was designed to generate pores of at least 200 microns in diameter. However, pore diameters were typically 150 microns, possibly because of lower temperatures reached after impact (960° C. preform temperature as measured with a two-color pyrometer), compared to 1200° C. obtained in conventional microsphere processing. Average grain size was reduced to about 40 microns.

EXAMPLE 3

Preform C

A preform was made in exactly the same manner as in Example 2, except that 0.03 wgt % of $BaCO_3$ was injected into the point of atomization. As shown in Table 1, the density reduction was 8.1%, compared to the cast feedstock, and 5.2%, compared to Preform A containing no blowing agent. The porosity was 8.1%.

EXAMPLE 4

Preform D

This preform was made with 0.06 wgt. % of $BaCO_3$ which was injected into the point of atomization. As shown in Table 1, the density reduction from Preform A was 6.0%, and the porosity was 8.9%.

EXAMPLE 5

Preform E

This preform was made with 0.05 wgt. % of $BaCO_3$ As shown in Table 1, the density reduction from Preform A was a surprising 17.2%, and the porosity was 20.1%.

EXAMPLE 6

Preform F

This preform was made with 0.12 wgt. % of $BaCO_3$. As given in Table 1, the density reduction from Preform A was 19.5%, and the porosity was 22.4%.

EXAMPLE 7

Preform G

This preform was made with 0.18 wgt. % of $BaCO_3$. As given in Table 1, the density reduction from Preform A was 26.3%, and the porosity was almost 30%.

In general, nitrogen pores (those with diameters less than 20 microns) were present in these preforms, although somewhat less in number. The majority of the larger pores, attributed to $BaCO_3$ decomposition, accounted for most of the density reduction. The majority of these larger pores had diameters in the range of 100 to 250 microns, the area median diameter being 180 microns for Preform G, as shown in FIG. 4.

EXAMPLE 8

As a control experiment, a phosphor bronze preform was produced with an inert second phase (−100 mesh AISI 4335 powders) injected into the spray using similar deposition conditions. The resultant microstructure showed little tendency towards clumping of AISI 4335 powders, comparable matrix grain size, and no significant porosity other than fine nitrogen porosity at the matrix grain boundaries.

CHEMICAL CONTENT

Compared to the starting feedstock, small reductions in tin content and larger reductions in oxygen levels were the only changes in chemistry that occurred during spray forming without agent injection, as shown in Table 2. Higher silicon and oxygen levels occurred in Preform B because of glass injection. Barium content in Preforms C, E, and G increased with the percentage of $BaCO_3$ injection.

MECHANICAL PROPERTIES

Figure 5:
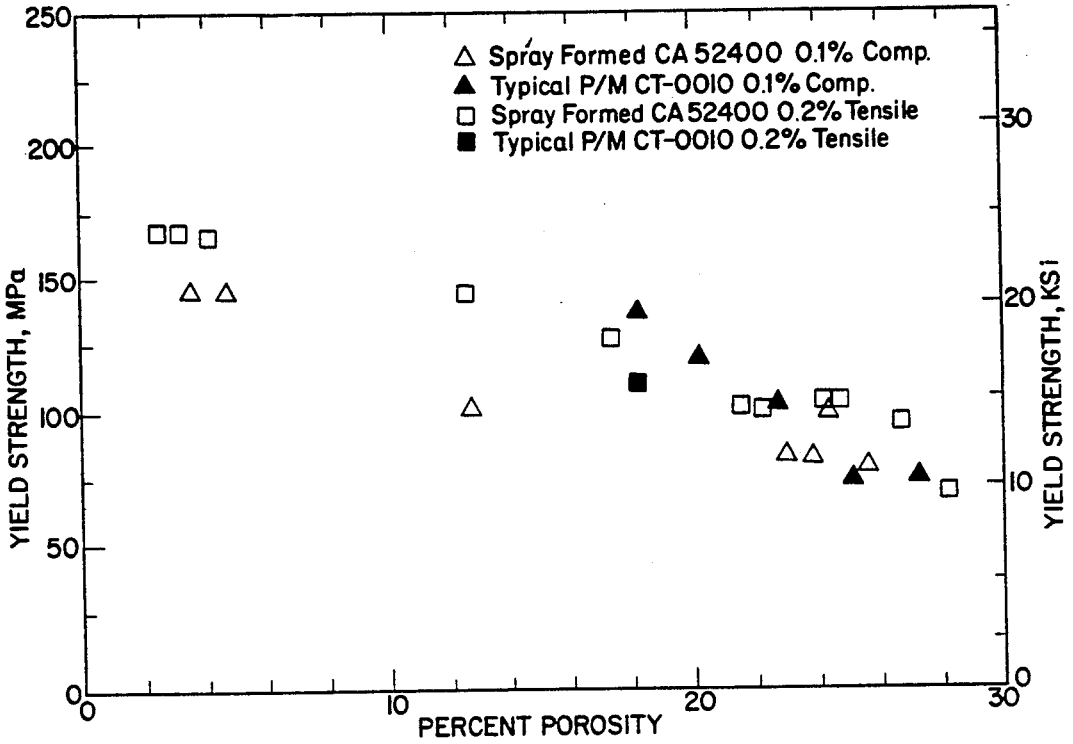
FIG. 5 is a plot of compressive and tensile yield strength versus percent porosity, taken from three preforms.

Compressive and tensile yield strengths for the spray formed preforms, with and without barium carbonate injection, are plotted in FIG. 5. At a given porosity level, the spray formed material has about the same strength as typical P/M Cu-10Sn product.

Figure 6:
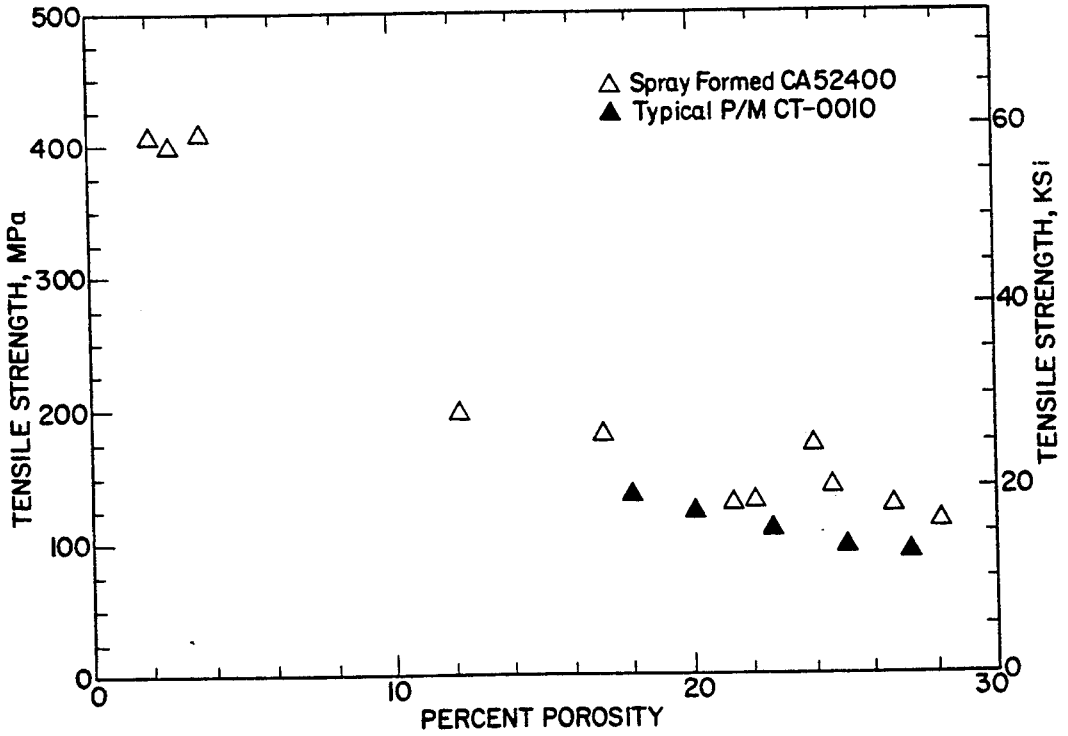
FIG. 6 is a plot of ultimate tensile strength versus percent porosity, taken from three preforms.
Figure 7:
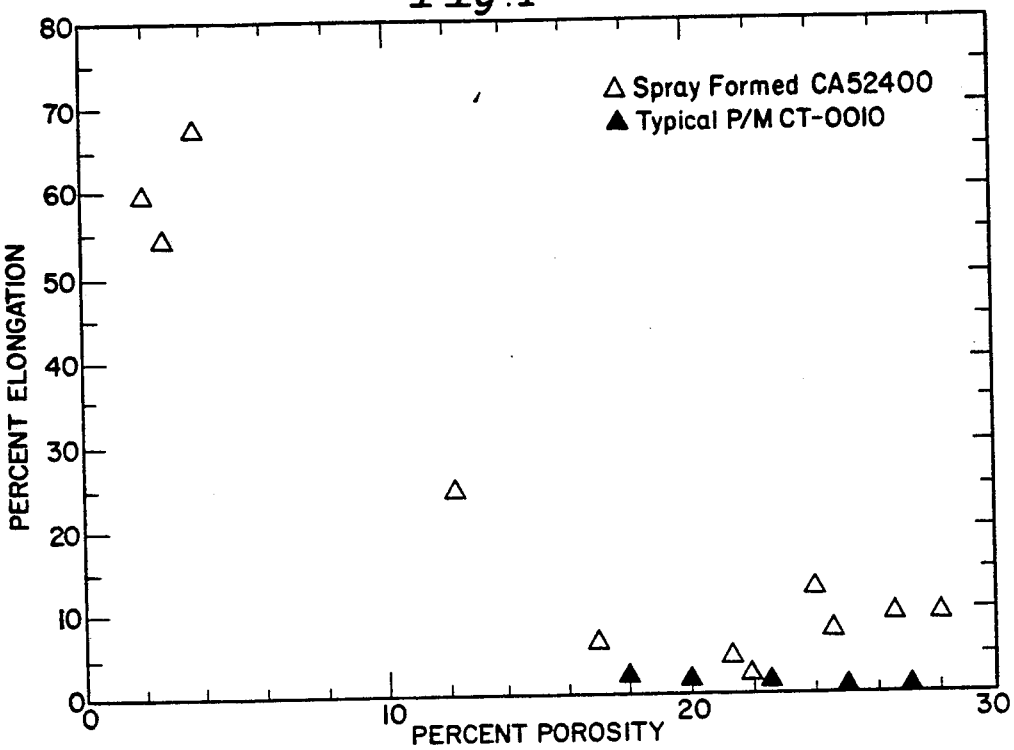
FIG. 7 is a plot of tensile elongation versus percent porosity, taken from three preforms.

Ultimate tensile strength of the spray formed material was slightly greater than typical P/M values, as shown in FIG. 6. Elongation to failure was superior to the P/M material at the same density, especially in the lower density specimens, as shown in FIG. 7. High elongation can be attributed to a low ratio of yield strength (YS) to ultimate tensile strength (UTS), thereby allowing yielding to occur in the bulk of the material before localized rupture at the pore surface. The following formula for is a measure of ductility:

$$YS/UTS < 1-1.21\epsilon^{0.67}$$

where $\epsilon$ is volume fraction porosity. Using handbook values for yield and ultimate strength indicates that significant ductility can be maintained in this alloy up to 32% porosity.

Figure 8:
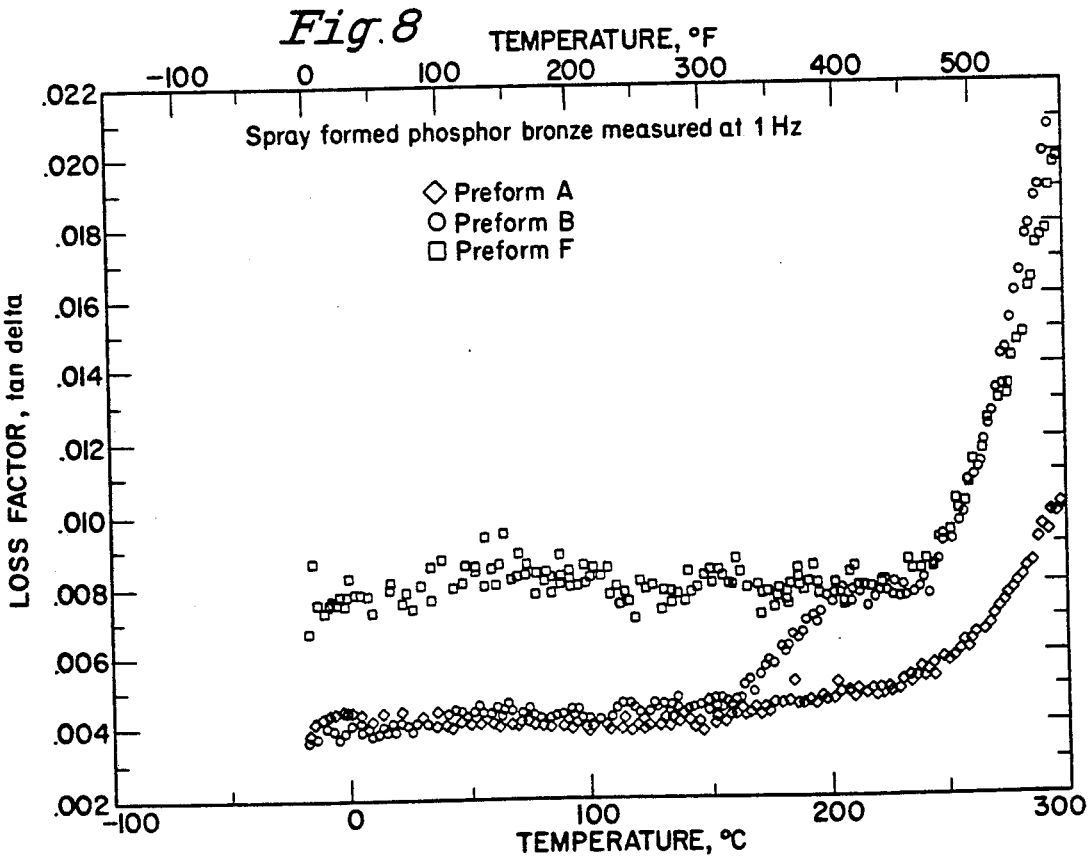
FIG. 8 is a plot of damping capacity (tan delta) versus temperature for material that was spray formed without injection, spray formed with glass frit, and spray formed with $BaCO_3$ injection.

Damping response as a function of temperature is plotted in FIG. 8. Injection of glass precursor frit resulted in improved damping capacity at only the higher range of test temperatures; at room temperature, the damping capacity was essentially unchanged. Injection of barium carbonate resulted in modest improvements; damping capacity at low temperatures was increased by a factor of two, and greater improvements, equal to the glass precursor frit capacity, were obtained at higher temperatures.

While the foregoing embodiments are presently preferred, it is to be understood that numerous variations and modifications may be made therein by those skilled in the art; what is intended to be within the true spirit and scope of the invention is defined in the following claims.

What is claimed is:

1. A method for spray forming a preform on a substrate, said preform containing closed cell, spherical porosity for increased strength, comprising:

A. heating a metallic material to obtain a melted metallic material having a selected superheat;

B. passing said melted metallic material through a nozzle to form a melt stream;

C. accelerating said melt stream toward said substrate with a stream of an inert gas to form an atomized melt stream at a point of atomization;

D. injecting particles of a blowing agent into said point of atomization;

E. receiving said atomized melt stream mixed with said blowing agent particles on said substrate to form said preform, wherein said superheat is sufficient to produce a thixotropic semisolid deposition layer on said preform.

2. The method of claim 1, wherein said metallic material is selected from the group consisting of metals and metal alloys.

3. The method of claim 2, wherein said alloys are selected from the group consisting of copper based, nickel based, iron based, and aluminum based alloys.

4. The method of claim 1, wherein said blowing agent is selected from the group consisting of inorganic compounds, organic compounds, and elements having boiling temperatures, sublimation temperatures, or decomposition temperatures within the range of 425° C. and 1360° C.

5. The method of claim 4, wherein said inorganic compounds are selected from the group consisting of $BaCO_3$, $FeCO_3$, $NiCO_3$, $CdBr_2$, $CeO_2CO_3$, $Cs_2O_2$, $GaCl_2$, $PbBr_2$, $MnSO_4$, $K_2Cr_2O7$, KCNS, $RbBF_4$, $Rb_2CO_3$, $AgNO_3$, $NaClO_4.H_2O$, TlBr, TlCl, TlF, TlI, $ThI_4$, $SnBr_2$, $SnI_2$, $Y_2(SO_4)_3.H_2O$, $ZnBr_2$, and $ZnI_4$.

6. The method of claim 4, wherein said organic compounds are selected from the group consisting of metal carbonyls, metal hydrides, an poly(alkylene carbonates).

7. The method of claim 4, wherein said elements are selected from the group consisting of arsenic, cadmium, cesium, potassium, rubidium, selenium, sodiu, sulfur, and zinc.

8. The method claim 1, wherein a majority fraction of said blowing agent particles collide with said atomized melt stream and are heated by conduction, the remainder of said blowing agent particles being heated by convection and radiation.

9. The method of claim 1, wherein said blowing agent particles decompose within said deposition layer.

10. The method of claim 9, wherein the viscosity of said deposition layer is sufficient to entrap gas pores formed by decomposition of said blowing agent particles.

11. The method of claim 10, wherein said preform contains closed, spherical pores, the majority thereof having diameters in the range of 100 to 250 microns.

12. The method of claim 1, wherein said blowing agent particles are $BaCO_3$ particles of −270 mesh in size and said atomized metal stream is phosphor bronze powder of −140 mesh in size.

13. The method of claim 12, wherein said $BaCO_3$ particles are mixed with said phosphor bronze powder as a carrier of said $BaCO_3$ particles to form a mixture which is injected into said point of atomization.

14. The method of claim 13, wherein said $BaCO_3$ particles are 0.44 to 8.8 weight percent of said mixture.

15. The method of claim 14, wherein the feed rate of said mixture is within the range of 0.5 and 1.5 kg/minute.

16. The method of claim 1, further comprising the step of controlling size and flow rate of said blowing agent particles.

17. The method of claim 1, further comprising the step of controlling time during which said blowing agent particles are injected into said point of atomization.

18. The method of claim 17, wherein said blowing agent particles are injected into said deposition layer only at the center of said preform, whereby only said center is porous and said preform has a sandwich structure.

* * * * *